US008450592B2

(12) United States Patent
Feng et al.

(10) Patent No.: US 8,450,592 B2
(45) Date of Patent: May 28, 2013

(54) METHOD AND A SYSTEM FOR PROVIDING SOUND GENERATION INSTRUCTIONS

(75) Inventors: Kai Feng, Vanløse (DK); Lars Fox, Frederiksberg (DK); Lauge Rønnow, Copenhagen Ø (DK)

(73) Assignee: Circle Consult APS, Naerum (DK)

( * ) Notice: Subject to any disclaimer, the term of this patent is extended or adjusted under 35 U.S.C. 154(b) by 1067 days.

(21) Appl. No.: 12/441,135

(22) PCT Filed: Sep. 17, 2007

(86) PCT No.: PCT/DK2007/050129

§ 371 (c)(1),
(2), (4) Date: Mar. 12, 2009

(87) PCT Pub. No.: WO2008/034446

PCT Pub. Date: Mar. 27, 2008

(65) Prior Publication Data

US 2010/0004766 A1 Jan. 7, 2010

Related U.S. Application Data

(60) Provisional application No. 60/825,938, filed on Sep. 18, 2006.

(51) Int. Cl.
*G10H 1/00* (2006.01)

(52) U.S. Cl.
USPC ..... 84/626; 84/633; 84/662; 84/665

(58) Field of Classification Search
USPC ..... 84/626, 633, 662, 665
See application file for complete search history.

(56) References Cited

U.S. PATENT DOCUMENTS 4,909,117 A 3/1990 Reiling et al.
5,062,341 A 11/1991 Reiling et al.

(Continued)

FOREIGN PATENT DOCUMENTS

GB 2183076 5/1987
GB A2403338 12/2004
JP 2000298474 A 10/2000

OTHER PUBLICATIONS

Zhang, et al., A Study on Content-Based, Music Classification, 2 Pro. IEEE 113 (IEEE 2003).

(Continued)

*Primary Examiner* — David S. Warren
(74) *Attorney, Agent, or Firm* — K. David Crockett, Esq.; Niky Economy Syrengelas, Esq.; Crockett & Crockett, PC

(57) ABSTRACT

A method and a system for providing sound generation instructions from a digitized input signal are provided. The invention comprises transforming at least part of the digitized input signal into a feature representation, extracting characteristic features of the obtained feature representation, comparing at least part of the extracted characteristic features against stored data representing a number of signal classes, selecting a signal class to represent the digitized input signal based on said comparison, and selecting from stored data, which represents a number of sound effects, sound effect data representing the selected signal class. Sound volume data is determined from stored reference volume data corresponding to the selected signal class and/or sound effect and from at least part of the obtained characteristic features, and sound generation instructions are generated based at least partly on the obtained sound effect data and the obtained sound volume data. It is preferred that the sound generation instructions are forwarded to a sound generating system, and that a sound output corresponding to the digitized input signal is generated by use of said sound generating system and the sound generation instructions. The transformation of the digitized input signal into a feature representation may include the use of Fourier transformation, and the extraction of the characteristic features may comprise an extraction method using spectrum analysis and/or cepstrum analysis. For each signal class there may be corresponding reference volume data.

38 Claims, 17 Drawing Sheets

System structure and data representation

U.S. PATENT DOCUMENTS

| | | | | |
|---|---|---|---|---|
| 5,177,311 | A | 1/1993 | Suzuki et al. | |
| 5,350,881 | A | 9/1994 | Kashio et al. | |
| 5,680,512 | A * | 10/1997 | Rabowsky et al. | 704/504 |
| 6,150,947 | A | 11/2000 | Shima | |
| 7,081,581 | B2 * | 7/2006 | Allamanche et al. | 84/616 |
| 7,829,778 | B2 * | 11/2010 | Gatzsche et al. | 84/615 |
| 7,982,122 | B2 * | 7/2011 | Gatzsche et al. | 84/613 |
| 2004/0074378 | A1 * | 4/2004 | Allamanche et al. | 84/616 |
| 2008/0307945 | A1 * | 12/2008 | Gatzsche et al. | 84/477 R |
| 2010/0004766 | A1 * | 1/2010 | Feng et al. | 700/94 |

OTHER PUBLICATIONS

Lu, et al., Content-Based Audio Classification and Segmentation by Using Support Vector Machines, 8 Multimedia Systems 482, 2003.

Oppenheim, et al., From Frequency to Quefrency: A History of the Cepstrum, 5 Signal Processing Magazine (IEEE 2004).

Logan, Mel Frequency Cepstral Coefficients for Music Modelling, Cambridge Research Laboratory, Compaq Computer Co.

Molau, et al., Computing Mel-Frequency Cepstral Coefficients on the Power Spectrum, Acoustics, Speech, and Signal Processing, 2001.

Cooley, et al., An Algorithm for the Machine Calculation of Complex Fourier Series, 19 Mathematics of Computation 1965.

Combrinck, et al., On the Mel Scaled Cepstrum, University of Pretoria, South Africa.

Discrete Cosine Transform, (Jul. 16, 2006), available at http://en.wikipedia.org/w/index.php? title=Discrete_cosine_transform &oldid=64153010.

Bishop, Neural Networks for Pattern Recognition, Oxford Clarendon Press 1997, ISBN:0-19-853864-2.

* cited by examiner

System structure and data representation

Classification

Spectrum analysis example

Spectrum analysis

A

B

C

Spectrum and Cepstrum

D

E

Spectrum and Cepstrum

Sound wave recorded from beating a cup

The spectrum of sound wave from a cup

The Cepstrum of sound wave from a cup

MFCC

Binary representation of class regions

2-d Gaussian distribution

Output mapping block diagram

Principle task scheduling

Optimised task scheduling

METHOD AND A SYSTEM FOR PROVIDING SOUND GENERATION INSTRUCTIONS

FIELD OF THE INVENTION

The present invention relates generally to a method and a system for providing sound generations instructions. More particularly the invention relates to a method and a system wherein sound generation instructions are produced based on extracted characteristic features obtained from a digitized input signal, which may be produced from detected sound and/or vibration signals. A sound output may be produced based on the sound generation instructions.

BACKGROUND OF THE INVENTION

Computer technology is continually advancing, providing computers with continually increasing capabilities. One such increased capability is audio information retrieval. Audio information retrieval refers to the retrieval of information from an audio signal. This information can be the underlying content of the audio signal, or information inherent in the audio signal.

One fundamental aspect of audio information retrieval is classification. Classification refers to placing the audio signal or portions of the audio signal into particular categories. There is a broad range of categories or classifications that may be used in audio information retrieval, including speech, music, environment sound, and silence. It should be noted that classification techniques similar to those used for audio signal also may be used for placing a detected vibration signal into a particular category.

When an input signal has been classified, the obtained result may be used in different ways, such as for determining a sound effect, which may be used for selecting a type of sound to be outputted by a sound generating system. However, as the intensity of the input may vary, there is a need for a method and a system, which will provide sound generation instructions carrying information of both a selected type of sound and a corresponding sound volume. The present invention brings a solution to this need.

SUMMARY OF THE INVENTION

According to the present invention there is provided a method for providing sound generation instructions from a digitized input signal, said method comprising:

- transforming at least part of the digitized input signal into a feature representation,
- extracting characteristic features of the obtained feature representation,
- comparing at least part of the extracted characteristic features against stored data representing a number of signal classes,
- selecting a signal class to represent the digitized input signal based on said comparison,
- selecting from stored data representing a number of sound effects sound effect data representing the selected signal class, and
- generating sound generation instructions based at least partly on the obtained sound effect data.

The method of the present invention may further comprise the step of determining sound volume data from stored reference volume data corresponding to the selected signal class and/or sound effect and from at least part of the obtained characteristic features, and the generated sound generation instructions may further be based at least partly on the obtained sound volume data.

According to the present invention there is also provided a method for providing sound generation instructions from a digitized input signal, said method comprising:

- transforming at least part of the digitized input signal into a feature representation,
- extracting characteristic features of the obtained feature representation,
- comparing at least part of the extracted characteristic features against stored data representing a number of signal classes,
- selecting a signal class to represent the digitized input signal based on said comparison,
- selecting from stored data representing a number of sound effects sound effect data representing the selected signal class,
- determining sound volume data from stored reference volume data corresponding to the selected signal class and/or sound effect and from at least part of the obtained characteristic features, and
- generating sound generation instructions based at least partly on the obtained sound effect data and the obtained sound volume data.

It is within an embodiment of the methods of the present invention that the selection of a signal class and the selection of sound effect data are performed as a single selection step.

The methods of the present invention may further comprise forwarding the sound generation instructions to a sound generating system, and

- generating by use of said sound generating system and the sound generation instructions a sound output corresponding to the digitized input signal.

According to an embodiment of the present invention, the stored data representing signal classes may be data representing signal classification blocks.

It is preferred that the step of transforming the digitized input signal into a feature representation includes a time-frequency transformation. Preferably, the step of transforming the digitized input signal into a feature representation includes the use of Fourier transformation.

It is within an embodiment of the invention that the step of extracting the characteristic features comprises an extraction method using spectrum analysis and/or cepstrum analysis.

For embodiments of the present invention using the time-frequency transformation, the time frequency transformation may comprise dividing at least part of the digitized input signal into a number of time windows M, with M being at least two, with a frequency spectrum being obtained for each input signal time window. Here, for each time window M, the frequency component having maximum amplitude may be selected, to thereby obtain a corresponding number M of characteristic features of the digitized input signal. It is preferred that each stored signal classification block has a frequency dimension corresponding to the number of time windows M. For each dimension M there may be frequency limit values to thereby define the frequency limits of the classification block. The obtained M maximum amplitude frequencies of the digitized input signal may be compared to the stored signal classification blocks, and the selection of a signal class may be based on a match between the obtained frequencies and the stored signal classification blocks. The number of time windows M, may also be larger than two, such as 3, 4, 5, 6 or larger.

It is also within one or more embodiments of the present invention that the step of extracting the characteristic features comprises an extraction method based on one-window cepstrum analysis. Here, Cepstral coefficients may be obtained by use of Fast Fourier Transform (FFT) or Discrete Cosine Transform (DCT). It is also within embodiments of the methods of the invention using cepstrum analysis that a number N of Mel Frequency Cepstral Coefficients, MFCC, may be obtained for a single time window representing a part of the digitized input signal, and each stored signal classification block may have a dimension corresponding to the number N of MFCC's. It is preferred that N is selected from the group of numbers represented by 2, 3, 4, 5, 6, 7 and 8.

The methods of the present invention also cover embodiments wherein for each signal class there is corresponding stored sound effect data indicative of a sound effect belonging to the selected signal class. It is also preferred that for each signal class there is corresponding reference volume data.

For methods of the invention wherein time-frequency transformation is used in transforming the digitized input signal into the feature representation, one or more maximum amplitudes may be obtained for corresponding peak frequencies from the characteristic features of the digitized input signal, and the sound volume data may be determined based on the obtained maximum amplitude(s) and the stored reference volume data.

For methods of the invention wherein time-frequency transformation is used in transforming the digitized input signal into the feature representation, then for a selected signal class the stored reference volume data may be at least partly based on a number of training maximum amplitudes, which may be obtained at corresponding peak frequencies, and which are obtained during a preceding training process including generation of several digitized input signals, each said digitized input signal being based on one or more generated signals to be represented by the selected signal class.

For methods of the invention wherein time-frequency transformation is used in transforming the digitized input signal into the feature representation, the stored signal class data may be at least partly based on a number of training maximum amplitude or peak frequencies obtained during a preceding training process including generation of several digitized input signals, each said digitized input signal being based on one or more generated signals to be represented by the selected signal class.

It is within an embodiment of the present invention that the step of selecting sound effect data representing a selected signal class includes a mapping process in which the selected class is mapped into one or more given sound effects based on a predetermined set of mapping rules.

According to the present invention there is also provided a system for providing sound generation instructions from a digitized input signal, said system comprising:

memory means for storing data representing a number of signal classes and a number of sound effects, one or more signal processors, and a sound generating system, said signal processor(s) being adapted for transforming at least part of the digitized input signal into a feature representation, for extracting characteristic features of the obtained feature representation, for comparing at least part of the extracted characteristic features against the stored data representing a number of signal classes, for selecting a signal class to represent the digitized input signal based on said comparison, for selecting from the stored data representing the number of sound effects sound effect data corresponding to or representing the selected signal class, and for generating sound generation instructions and forwarding said sound generation instructions to the sound generating system, said sound generation instructions being based at least partly on the obtained sound effect data.

It is within a preferred embodiment of the system of the invention that the data stored in the memory means further represent reference volume related data corresponding to the signal classes and/or sound effects, and that the signal processor(s) is/are further adapted for determining sound volume data from stored reference volume data corresponding to the selected signal class and/or sound effect and from at least part of the obtained characteristic features, and that the signal processor(s) is/are further adapted for generating the sound generation instructions based at least partly on the obtained sound effect data and the obtained sound volume data.

According to the present invention there is further provided a system for providing sound generation instructions from a digitized input signal, said system comprising:

memory means for storing data representing a number of signal classes and a number of sound effects and further representing reference volume related data corresponding to the signal classes and/or sound effects, one or more signal processors, and a sound generating system, said signal processor(s) being adapted for transforming at least part of the digitized input signal into a feature representation, for extracting characteristic features of the obtained feature representation, for comparing at least part of the extracted characteristic features against the stored data representing a number of signal classes, for selecting a signal class to represent the digitized input signal based on said comparison, for selecting from the stored data representing the number of sound effects sound effect data corresponding to or representing the selected signal class, for determining sound volume data from stored reference volume data corresponding to the selected signal class and/or sound effect and from at least part of the obtained characteristic features, and for generating sound generation instructions and forwarding said sound generation instructions to the sound generating system, said sound generation instructions being based at least partly on the obtained sound effect data and the obtained sound volume data.

It is within an embodiment of the systems of the present invention that the signal processor(s) is/are adapted to perform the selection of a signal class and the selection of sound effect data as a single selection step.

It is within an embodiment of the systems of the invention that the stored data representing signal classes are data representing signal classification blocks.

It is preferred that the signal processor(s) is/are adapted for transforming the digitized input signal into a feature representation by use of time-frequency transformation. It is also preferred that the signal processor(s) is/are adapted for transforming the digitized input signal into a feature representation by use of Fourier transformation.

The systems of the present invention also cover embodiments the signal processor(s) is/are adapted for extracting the characteristic features by use of an extraction method comprising spectrum analysis and/or cepstrum analysis.

It is within an embodiment of the systems of the invention that the signal processor(s) is/are adapted for dividing at least part of the digitized input signal into a number of time windows M, with M being at least two. Here, the signal processor(s) may be adapted for using spectrum analysis for extracting the characteristic features with a frequency spectrum being obtained for each input signal time window. It is preferred that for each time window M, the signal processor(s) is/are adapted to select the frequency component having maximum amplitude, to thereby obtain a corresponding number M of characteristic features of the digitized input signal. Each stored signal classification block may have a frequency dimension corresponding to the number of time windows M. It is further preferred that the signal processor(s) is/are adapted to compare the obtained M maximum amplitude frequencies of the digitized input signal to the stored signal classification blocks, and further being adapted to select a signal class based on a match between the obtained frequencies and the stored signal classification blocks. The number of time windows M, may also be larger than two, such as 3, 4, 5, 6 or larger.

It is also within one or more embodiments of the system of the invention that the signal processor(s) is/are adapted for extracting the characteristic features by use of an extraction method based on one-window cepstrum analysis. Here, Cepstral coefficients may be obtained by use of Fast Fourier Transform (FFT) or Discrete Cosine Transform. It is also within embodiments of the invention using cepstrum analysis that the signal processor(s) may be adapted for obtaining a number N of Mel Frequency Cepstral Coefficients, MFCC, for a single time window representing a part of the digitized input signal, and each stored signal classification block may have a dimension corresponding to the number N of MFCC's. It is preferred that N is selected from the group of numbers represented by 2, 3, 4, 5, 6, 7 and 8.

The systems of the invention also cover embodiments wherein for each signal class there is corresponding stored sound effect data indicative of the sound effect belonging to the selected signal class. It is also within embodiments of the systems of the invention that for each signal class there is corresponding reference volume data.

According to one or more embodiments of the systems of the invention, wherein the signal processor(s) is/are adapted for using spectrum analysis for extracting the characteristic features, then the signal processor(s) may be adapted for determining one or more maximum amplitudes for corresponding peak frequencies from the characteristic features of the digitized input signal, and the signal processor(s) may further be adapted to determine the sound volume data based on the obtained maximum amplitude(s) and the stored reference volume data.

According to one or more embodiments of the systems of the invention, wherein the signal processor(s) is/are adapted for using spectrum analysis for extracting the characteristic features, then for a selected signal class the stored reference volume data may be at least partly based on a number of training maximum amplitudes obtained at corresponding peak frequencies during a training process including generation of several digitized input signals, and each said digitized input signal may be based on one or more generated signals to be represented by the selected signal class.

According to one or more embodiments of the systems of the invention, wherein the signal processor(s) is/are adapted for using spectrum analysis for extracting the characteristic features, the stored signal class data may be at least partly based on a number of training maximum amplitude frequencies or peak frequencies obtained during a training process including generation of several digitized input signals, each said digitized input signal being based on one or more generated signals to be represented by the selected signal class.

It is within one or more embodiments of the systems of the invention that the signal processor(s) is/are adapted for selecting sound effect data representing a selected signal class by use of a mapping process in which the selected class is mapped into one or more given sound effects based on a predetermined set of mapping rules.

It should be understood that according to the methods and systems of the present invention the digitized input signal(s) may be based on detected sound and/or vibration signal(s) being generated when a first body is contacting a second body.

Other objects, features and advantages of the present invention will be more readily apparent from the detailed description of the preferred embodiments set forth below, taken in conjunction with the accompanying drawings.

DETAILED DESCRIPTION OF THE INVENTION

Sound generation instruction methods and systems according to embodiments of the present invention may be used in different audio systems, including audio systems where an audio output signal is generated based on a detected sound or vibration signal, which may then be digitized to form a digitized input signal.

An audio and/or vibration signal may for example be generated by hitting or touching an object by a stick, a hand or a plectrum. The object may for example be a table, a book, a cup, a string (guitar, bas), a bottle, or a bar of a xylophone. The generated signal may for example be sensed or collected by a microphone, a g-sensor, an accelerometer and/or a shock sensor.

The signal may be a pure audio signal or a vibration signal or both. While a pure audio signal collected by a microphone may be sufficient in order to classify the signal-generating object, other type of sensors may be used in order to eliminate faulty signals due to inputs collected from the surroundings.

The sensors may be incorporated in the touching/hitting item. If a hand of a human being is used for touching the object, a special glove could be used where the sensors may be attached to the glove. Such a glove may for example be used if the user would like to play artificial congas.

If the item used for hitting/touching the object is a drumstick, the sensors could be built into the stick or attached to the stick as an add-on rubber hood or collar. The sensor, which may be a microphone, may then collect the sound from the impact and an embedded circuit, which may be incorporated in the same sensor unit, Unit A, as the sensor, may then send the detected signal via cables or wireless to a processing unit, Unit B. Shock sensors or g-sensors could be used in order to mute the input signal so that only the audio signal generated by the drumstick is collected and passed on to unit B.

The processing unit, Unit B, may then do the signal processing, which may include classification, determination of magnitude, and mapping to a selected output file.

In the drumstick example, the input signal obtained when beating a cup with the stick could be mapped to an output audio signal of a high hat. An input signal obtained when beating a table with the stick could be mapped to an audio signal of a snare drum.

The output signal from the processing in Unit B, may be stored in Unit B. Additionally, the processing unit may send a signal through a MIDI interface to a sound module. This would enable the user to use a lot of sounds that are available from different vendors. When the output signal obtained from unit B is used, such output signals could be sent to an audio output port, which is compatible with HI-FI stereos.

Figure 1A:
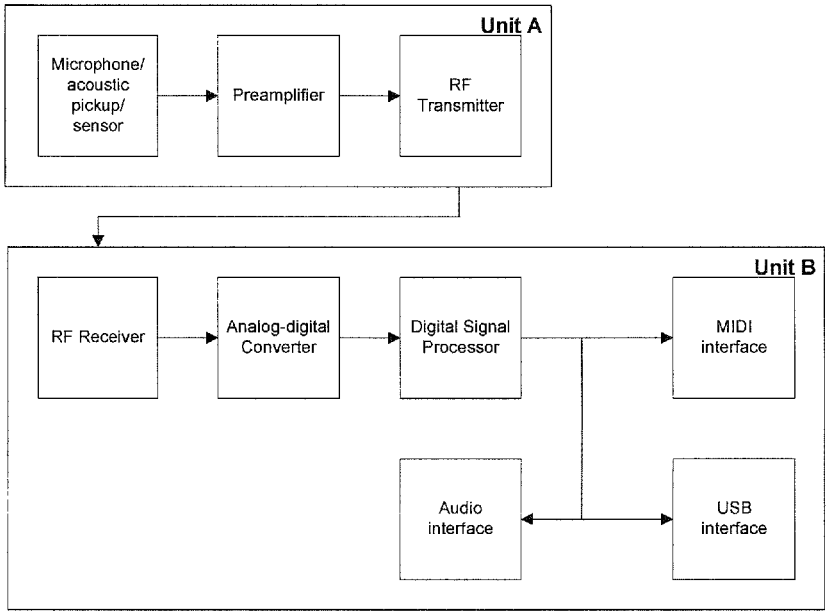
FIG. 1*a* shows the block diagram of an audio system based on the principles of the present invention and having a separate sensor unit, Unit A, and a separate processing unit, Unit B.

An example of the architecture of a sensor unit, Unit A, and a processing unit, Unit B, is shown in FIG. 1*a*. Here, Unit A comprises a sensor, which may be a microphone or acoustic pickup sensor, a preamplifier, and a RF transmitter. The processing unit, Unit B, comprises a RF receiver, an analog to digital converter, ADC, one or more digital signal processors, an audio interface, a MIDI interface and a USB interface.

Figure 1B:
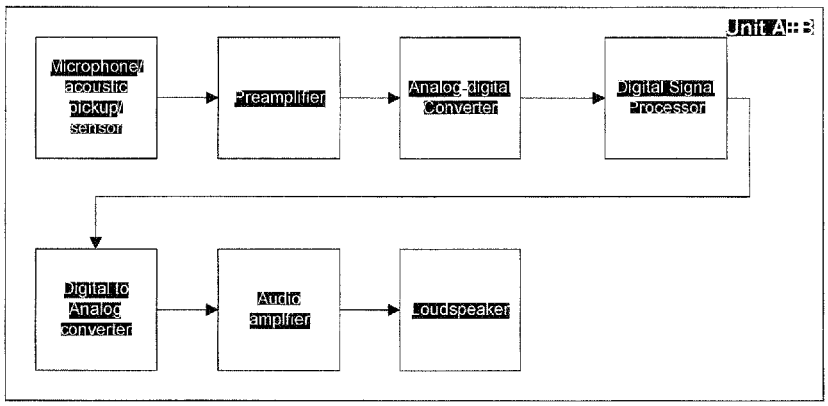
FIG. 1*b* shows the block diagram of an audio system based on the principles of the present invention and having a sensor unit, Unit A, and a processing unit, Unit B, arranged together in one unit.

The sensor and processing units, Unit A and Unit B, may be incorporated into one unit as illustrated in FIG. 1*b*. The system shown in FIG. 1*b* also has a loudspeaker for producing the resulting audio output based on the output from the audio interface, which is this case is an audio amplifier. The implementation illustrated in FIG. 1*b* may particularly be relevant for toys.

Classification System Structure

Figure 2A:
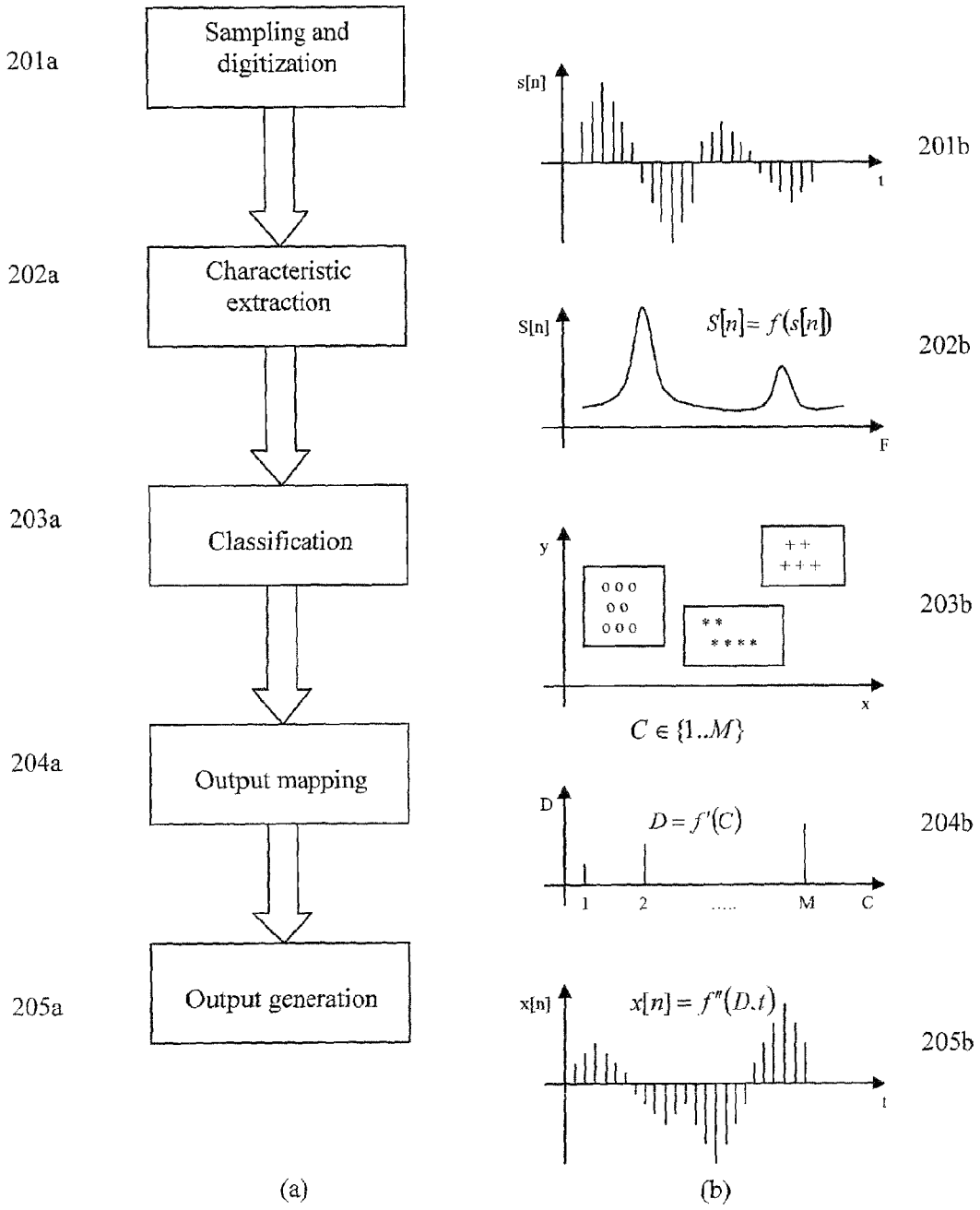
FIG. 2*a* shows a block diagram together with corresponding graphs illustrating a classification system structure and data flow for a method according to an embodiment of the present invention.

FIG. 2*a* shows a block diagram (a) together with corresponding graphs (b) illustrating a classification system structure and data flow for a method according to an embodiment of the present invention. The input to the system is a time signal s(t), e.g. a sound signal. The s(t) signal is processed by the first block 201*a* of the system with sampling and digitisation. This block will generate a discrete version of the time signal, denoted as s[n], 201*b*, where n is any integer Z.

The characteristic of the digitised signal is extracted by the second block 202*a*, called 'Characteristic extraction'. This block analyses and transforms the discrete signal into a proper representation, sometimes called feature, which best describes the signal property, denoted as S[n], 202*b*. An example of such transformation is Fourier transform. The representations of the signal properties can be spectrum, or cepstrum, see reference 1, and it can even be as simple as in time domain, The choice among different representations depends on the system requirement. There may currently be three feature extraction methods available, i.e. spectrum analysis (in terms of frequency components), cepstrum analysis (in terms of cepstrum coefficient) and time domain analysis (in terms of zeros crossing). Further details of each method will be described in the following sections.

The third block is 'Classification', 203*a*. This block takes the signal characteristic information S[n] as input, and categorises the discrete signal into a specific class, denoted as C. There may be M classes defined in the system as 'Class space', where M is any natural number N+. The categorization is done by using a classification coordinate system, 203*b*, and each axis may represent a property (or feature) of the input signal. The coordinate can be two-dimensional, e.g. each axis may represent the frequency with highest energy for a corresponding input signal time window when using spectrum analysis. Since the number of features is not constrained, the classification coordinate system 203*b* can be very high dimensional. The feature extracted from the second block 202*a* may be mapped onto the classification coordinate system 203*b*. If the mapping falls into a region that is predefined for a class in the coordinate system 203*b*, the input signal may be categorized to be in that class. If the mapping does not fall into any of the classes, the classification may be ended with inconclusive result. In order to reduce the number of misclassifications, the classification classes or blocks may be defined to be non-overlapping. The region or limits of a class or block may be determined by statistical studies or learning processes. The details of region creation, management and mapping will be described in a later section.

The classification result C may further be processed by a fourth block, 'Output mapping', 204*a*. This block may use a function f' to transform the classification result C into a decision D, illustrated by 204*b*. The mapping from classification C to decision D may be a continuous function or a discrete function, and does not have to be linear.

The decision result D is input to a block 'Output generation', 205*a*, which generates an output signal x[n], 205*b*.

An example may be as described below:

The classification system is constructed for sound signals. The time signal s(t) is sampled by a microphone, and digitized by an A/D converter with sampling frequency of 48 kHz, 201*a*. The digitized time signal s[n], 201*b*, is recorded for 30 ms (milliseconds). It is then divided into two time windows each with a duration of 15 ms, corresponding to 720 samples for each window.

In the characteristic extraction block, 202*a*, spectrum analysis is taken in this example. Frequency components are computed using Fast Fourier Transform for each of the two time windows. The transformation will result in a two-sided spectrum. Only the positive spectrum is used. The frequency component with highest energy is selected from each window as a feature. For two time windows, two features will be found in this example.

Figure 2B:
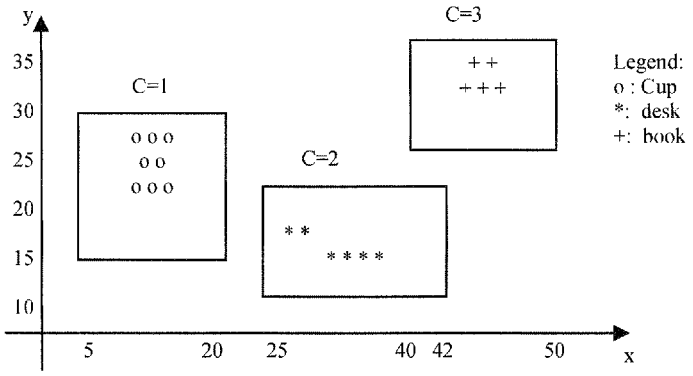
FIG. 2*b* illustrates an example of a two-dimensional sound classification block system according to an embodiment of the present invention.

In the classification block, 203*a*, a coordinate will be formed. Since there are two features, the coordinate system will only be two-dimensional. The features are mapped onto the classification coordinate system, 203*b*. Assuming there are three classes defined in the system, e.g. the beat of a drum stick on a cup, a desk and a book, there will be three classifications blocks in the classification coordinate system. This is illustrated in FIG. 2*b*.

If the input signal recorded has peak frequency values of 30 and 15 Hz, corresponding to feature values of (30,15), which indicates that it is located between 25~42 on the x-axis, and on the y-axis is located between 10~20, then this signal falls into the region covered by 'beat of desk'. Therefore, such signal is classified to be generated by the desk and C=2.

The classification C is mapped to an output decision D, 204*a*. In this example, it is a linear mapping, as D=C, 204*b*. By output generation, 205*a*, the 2nd sound track is played and outputted though the D/A converter.

Sampling and Digitisation

According to one or more embodiments of the invention, the generated input signal is a continuous-time signal, such as a sound or vibration signal. In order to be processed by a digital signal processor, the continuous-time signal is converted to a discrete-time signal or digital input signal by sampling and digitization. The sampling and digitization is performed by an A/D converter (ADC), which takes the continues-time analogue signal as input, and produces the digital discrete signal. There are two requirements for the ADC, sampling frequency (Fs) and resolution (Res).

The sampling frequency determines the system maximum operating frequency according to Nyquist Sampling Theorem. The relation between the sampling frequency and system maximum operating frequency is shown below:

$$F_S > 2F_N$$

where $F_S$ is the sampling frequency, and $F_N$ is the system maximum working frequency (the Nyquist frequency). For example, if the system input is an audio signal with frequency between 20 Hz~22 kHz, the sampling frequency is required to be at least 44 kHz. In this system, the sampling frequency is determined by the specific product requirements for different version of implementation. For high-end electronics, 48 kHz sampling or more may be required. For conventional products such as toys, 20 kHz~44 kHz can be selected. The current implementation is using a 48 kHz ADC.

The resolution of the ADC is usually given in bits. An 8-bit ADC will provide 8 bits output, which gives 256 steps representing the input signal. A 16-bit ADC will have 65536 steps that gives finer details of the input signal. For high-end electronics, 16 bits~24 bits may be used; even higher resolution can be seen. For conventional products such as toys, 10 bits~16 bits can be acceptable. The current implementation is using 24 bits ADC.

The ADC can be on-chip or off-chip. There have been several commercial single chip ADC available on the market, such as AD1871 from Analog Devices, which is used in the current implementation. The ADC can also be integrated in the processor, such as ATmega128 from ATMEL, which has 8 channels of 10-bit ADC.

Description of Characteristic Extraction Algorithms

The aim of characteristic extraction is to extract features that the input signal posses. There may be several algorithms, which may be used for performing signal features extraction, such as spectrum analysis, cepstrum analysis and zero crossing analysis. The methods and systems of the present invention are not limited to these algorithms. Other algorithms may be developed and used for further implementation.

Spectrum Analysis

By using spectrum analysis the time domain input signal is transformed into the frequency domain by Fourier transformation. The amplitude of the spectrum is used for analysis. The input signal may be divided into time windows, so that they are stationary inside the window. The Fourier transform is computed as:

Discrete Fourier Transform:

$$X[k] = \frac{1}{N}\sum_{n=0}^{N-1} x[n]e^{-jn\frac{2\pi}{N}k}\, n,\ k = 1, 2, \ldots, N \qquad \text{Eq. 1}$$

where N is the number of points in transformation.

The fast version of DFT is fast Fourier transformation, FFT, see reference 4. The sound generated from a first body contacting a second body will have a major frequency component. The sound waves or signal being generated from different materials may have different major frequency components. The major frequency components can also be different from one time window to another. For a signal that is divided into M time windows, the FFT is applied to each window, and the spectrum can be represented as a matrix X[m][k]. The frequency component with maximum amplitude is selected for each time window, and forms a vector V=(f1,f2, . . . , fM). The vector corresponds to a point in an M-dimensional coordinate system. For M=2, corresponding to two time windows, the vector V is (f1,f2), and the coordinate system is two-dimensional.

As an example, sound signals generated from two materials are recorded. Each sound signal is divided into two time windows. By taking the FFT, the following spectra are found:

TABLE 1.1

Amplitude spectrum for two sound waves ($1^{st}$ window)

| | 100 Hz | 1 kHz | 2 kHz | 3 kHz | 4 kHz | 5 kHz | 6 kHz |
|---|---|---|---|---|---|---|---|
| Sound 1 | 150 | 1000 | 4000 | 950 | 800 | 400 | 100 |
| Sound 2 | 4500 | 2000 | 1500 | 800 | 500 | 200 | 50 |

TABLE 1.2

Amplitude spectrum for two sound waves ($2^{nd}$ window)

| | 100 Hz | 1 kHz | 2 kHz | 3 kHz | 4 kHz | 5 kHz | 6 kHz |
|---|---|---|---|---|---|---|---|
| Sound 1 | 150 | 1000 | 1500 | 4000 | 800 | 400 | 100 |
| Sound 2 | 4500 | 2000 | 1500 | 800 | 500 | 200 | 50 |

Figure 3A:
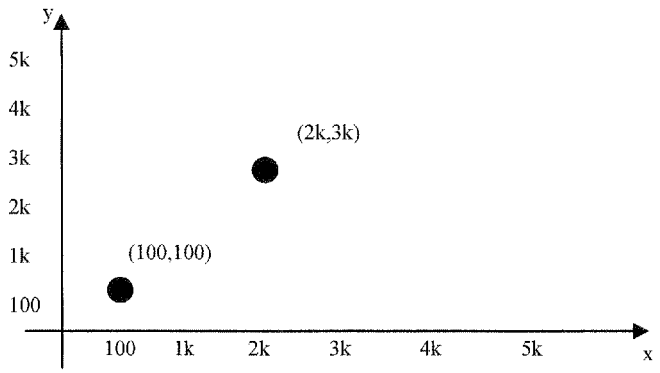
FIG. 3*a* illustrates an exemplary arrangement within a two-dimensional sound classification block system of two sound vectors based on characteristic features obtained from two different detected sounds and extracted by use of spectrum analysis according to an embodiment of the present invention.

For the first sound wave, Table 1.1, the frequencies with highest amplitude in the two windows are 2 kHz and 3 kHz respectively. For the second sound wave, the frequencies with highest amplitude in two windows are both at 100 Hz. The two vectors representing the two signals will then be (2000, 3000) and (100,100). These are plotted in the classification coordinate system as illustrated in FIG. 3*a*.

The examples illustrated in FIG. 2*b* are also obtained by spectrum analysis over two time windows of sound wave generated by three different materials.

The spectrum analysis algorithm has been tested upon four different materials, which have been hit by a drumstick. These are: Pepsi bottle filled with half bottle of water, BF533 hardware reference book (904 pages), a metal tea box, and a coffee cup. 20 sound samples are generated from each material and recorded. In total 80 sound records are tested by the algorithm. The result is shown in FIG. 3*b*, which shows a two-dimensional sound classification block system of sound vectors corresponding to detected sounds generated from these four materials.

Figure 3B:
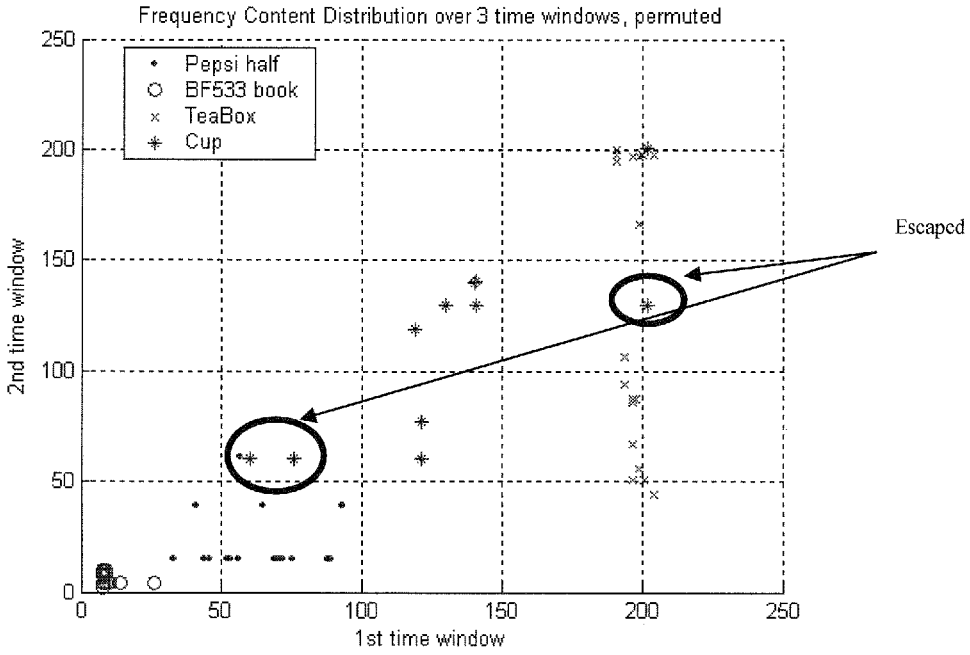
FIG. 3*b* illustrates the arrangement within a two-dimensional sound classification block system of sound vectors corresponding to detected sounds from four different materials and based on characteristic features obtained by use of spectrum analysis according to an embodiment of the present invention.

In FIG. 3*b*, for each sound record, the frequency components with highest amplitude over two windows are plotted as points in the coordinate system. These points are scattered in the coordinate system. The book points are located in the down-left corner. The Pepsi bottle points are next to the books. The tea box points are at the right hand side of the coordinate system. The majority of the cup points are located in the middle of the coordinate system, but there are several points far from the majority, and marked by circles and labelled as 'escaped'.

Cepstrum Analysis

The theoretical background of cepstral coefficient analysis can be found in references 1, 2, 3 and 5. In the following is given a brief description.

The spectrum analysis described above provides the frequency components of the input signal by use of Fourier transformation. The frequency having the highest magnitude or amplitude is considered to be the feature. The sound generated from one material will have the same maximum amplitude frequency with certain variation. However, for some material, the variation of this frequency may be larger than for other material. For example, the frequency with the highest magnitude or amplitude of a cup can change anywhere between 10 kHz~20 kHz. Since it spreads all over the high frequency band, it is rather difficult to perform classification by spectrum analysis.

The Cepstrum analysis studies the spectrum of the signal. The Cepstrum of a signal may be found by computing the spectrum of the log spectrum of the signal, i.e.:

For input time domain signal s(t), the spectrum (frequency component) may be:

$$S=\mathrm{FFT}(s).$$

Taking the logarithm of the spectrum S, and define SL to be the log spectrum, then:

$$\mathrm{SL}=\log(S).$$

Compute the Fast Fourier transform again upon the log spectrum, then:

$$C=\mathrm{FFT}(\mathrm{SL}).$$

The new quantity C is called Cepstrum. It takes the log spectrum of the signal as input, and computes Fourier transform once again. The Cepstrum may be seen as information about rate of change in the different spectrum bands. It was originally invented for characterizing echo. This method has also been used in speech recognition. More commonly, instead of FFT, Discrete Cosine Transform (DCT) is used at the last step, i.e.:

Compute Discrete Cosine transform upon the log spectrum:

$$C=\mathrm{DCT}(\mathrm{SL}).$$

The advantage of DCT is that it has a strong "energy compaction" property: most of the signal information tends to be concentrated in a few low-frequency components of the DCT, see reference 6. In other words, the DCT can be used to represent the signal with lesser cepstral coefficients than FFT, while better approximating the original signal. This property simplifies the classification process, since different signal can be distinguished within few coefficients.

In the following the use of Cepstrum analysis is illustrated by an example. Several signals having different frequency components are constructed by use of MATLAB. The signal profiles are:

| Frequency | Amplitude |
|---|---|
| Signal A: | |
| 1 kHZ | 1 |
| Signal B: | |
| 1 kHz | 1 |
| 4 kHz | 0.5 |
| 8 kHz | 0.3 |
| Signal C: | |
| 1 kHZ | 1 |
| 8 kHz | 0.5 |
| 16 kHZ | 0.3 |
| Signal D: | |
| 7.5 kHZ | 0.1 |
| 15 kHz | 0.5 |
| 20 kHz | 0.7 |
| Signal E: | |
| 7.5 kHZ | 0.1 |
| 15 kHz | 0.7 |
| 20 kHz | 0.5 |

Figure 3C:
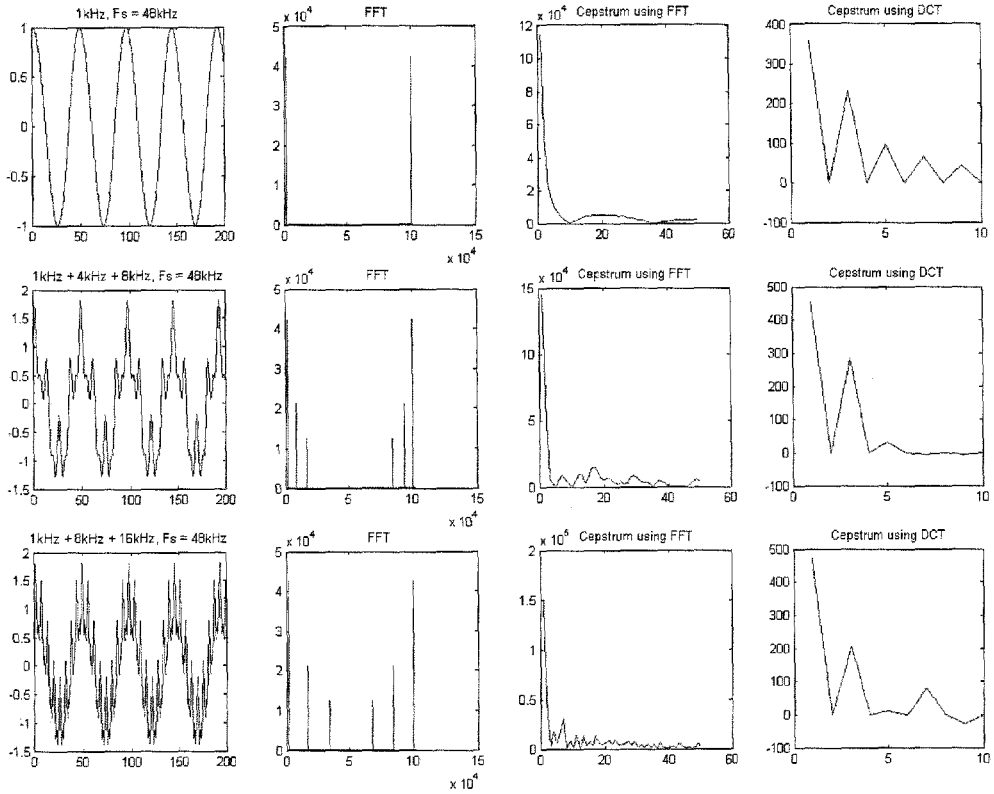
FIGS. 3*c* and 3*d* show signal diagrams for constructed signals having different frequencies, where the signal diagrams represent time domain, Spectrum, Cepstrum using FFT and Cepstrum using DCT.
Figure 3D:
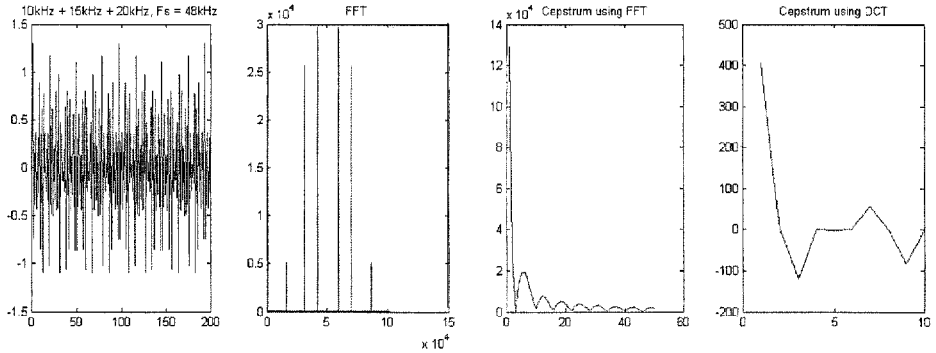
Figure 3D:
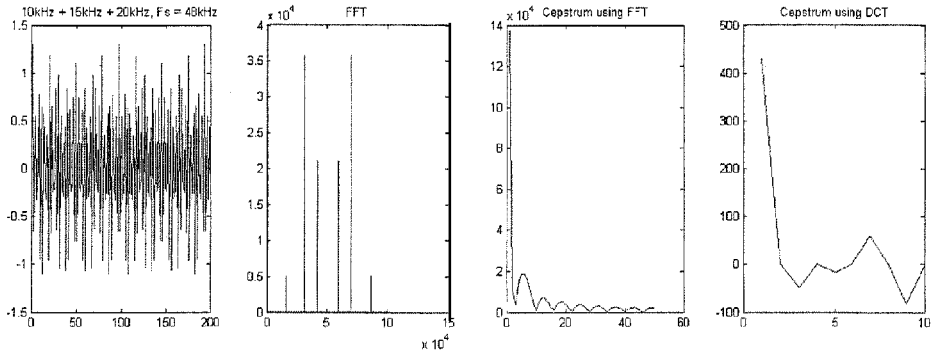

The Spectrum, Cepstrum using FFT and Cepstrum using DCT diagrams of the signals A-C are shown in FIG. 3*c*, while similar diagrams for signals D and E are shown in FIG. 3*d*. The first column of FIGS. 3*c* and 3*d* shows the signals A-C, D-E in the time domain. The x-axis represents the time, while the y-axis represents the frequency amplitude. The sampling frequency is 48 kHz, from which the corresponding time can be computed. The second column of FIGS. 3*c* and 3*d* shows the spectrum diagrams of the signals A-C, D-E; here, the x-axis represents frequency, and the y-axis represents the magnitude or amplitude. The third column shows the Cepstrum of the signals A-C computed by using FFT; here, the x-axis represents the so-called 'Quefrency' measured in ms (millisecond), and the y-axis represents the magnitude or amplitude of the Cepstrum. The fourth column shows the Cepstrum computed by using DCT instead of FFT; here the x and y axes are the same as for the third column plots.

The signal A is a signal with only one frequency component of 1 kHz. In the frequency domain, it shows a single pulse (two sided spectrum). Similarly, signals B~C will show pulses in the frequency domain. The Cepstrum of the three signals is very interesting. The Cepstrum of signal A shows a very smooth side-lop, whereas the Cepstrum of signals B~C have more ripples. In the Cepstrum computed with DCT, the Cepstrum of signal A is also very different to the Cepstrum computed with FFT. The FFT and DCT Cepstrums of signals B and C are rather similar. In fact, signals B and C do have similarities, they both have 1 kHz and 8 kHz frequency components. The frequency components 4 kHz and 8 kHz in B have a factor close to 2 in relationship, whereas for signal C, the 8 kHz and 16 kHz components are also a factor close to 2 in relationship.

For signals D and E in FIG. 3*d* it is noted that they have the same frequency components but with different magnitude. In signal D, the 20 kHz frequency component has highest magnitude, whereas in signal E, the 15 kHz frequency component has highest magnitude. For the spectrum analysis described above, this analysis may classify the two signals into two different classes. However, as shown in FIG. 3*d*, the Cepstrum diagrams for signals D and E have rather the same shape (in both the FFT version and the DCT version). Thus, when using Cepstrum analysis, the two signals D and E have a very close relationship.

Figure 3E:
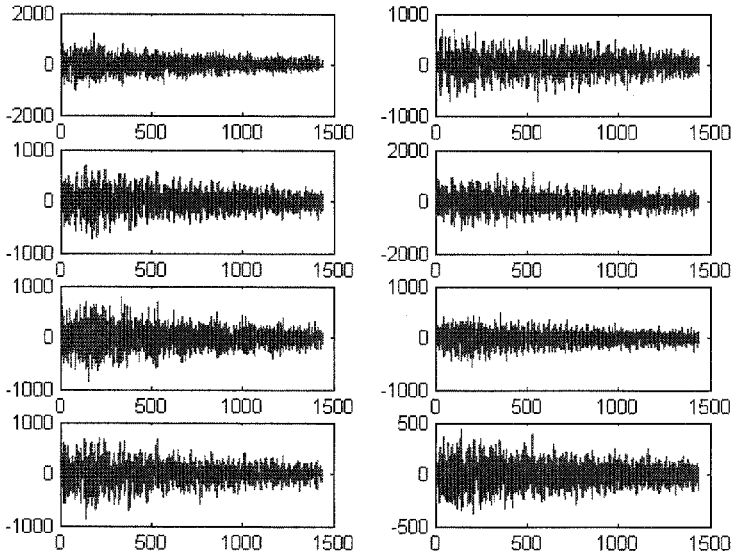
FIG. 3*e* shows sound signals in the time domain for sound signals generated from beating a cup with a stick.

The examples illustrated in FIGS. 3*e* and 3*d* are based on signals that are generated from MATLAB. In the following signals generated from a physical material and recorded will be discussed. The sound signals are generated from beating a cup with a stick. The generated eight signals are shown in the time domain in FIG. 3*e*, with the corresponding FFT Spectra shown in FIG. 3*f*. In FIG. 3*e* the x-axis represents the time and the y-axis the signal magnitude or amplitude, while in FIG. 3*f* the x-axis represents frequency, and the y-axis represents the magnitude or amplitude.

Figure 3F:
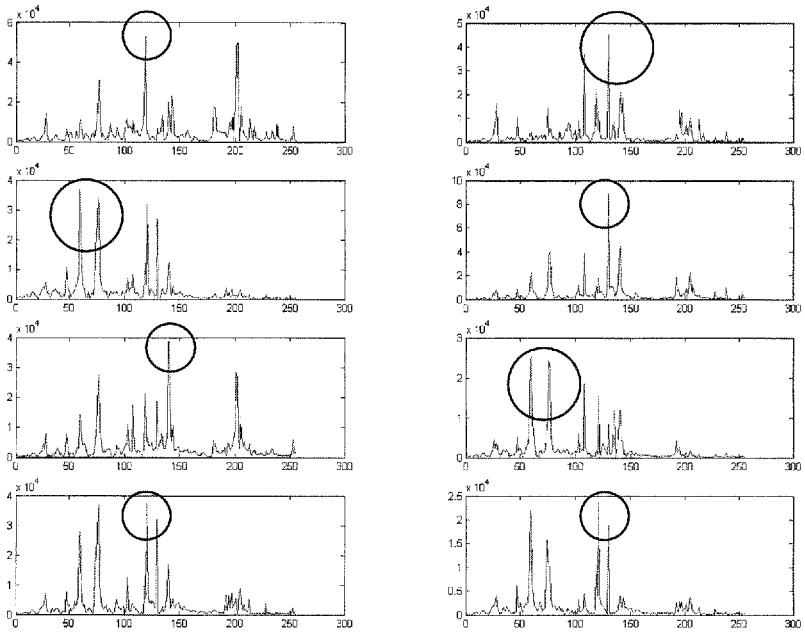
FIG. 3*f* shows the Spectrum diagrams corresponding to the time domain diagrams of FIG. 3*e*.

From FIG. 3*f* it is seen that the frequency component with highest magnitude is somewhere between 100~150 (which corresponds to 9.3 kHz~14 kHz). However, there are signals where the frequency with highest magnitude is located between 50~100 (which corresponds to 4.6 kHz 9.3 kHz), e.g. the plot shown in 2nd row, 1st column and the plot shown in 3rd row, 2nd column. These two spectra may be misclassified.

Figure 3G:
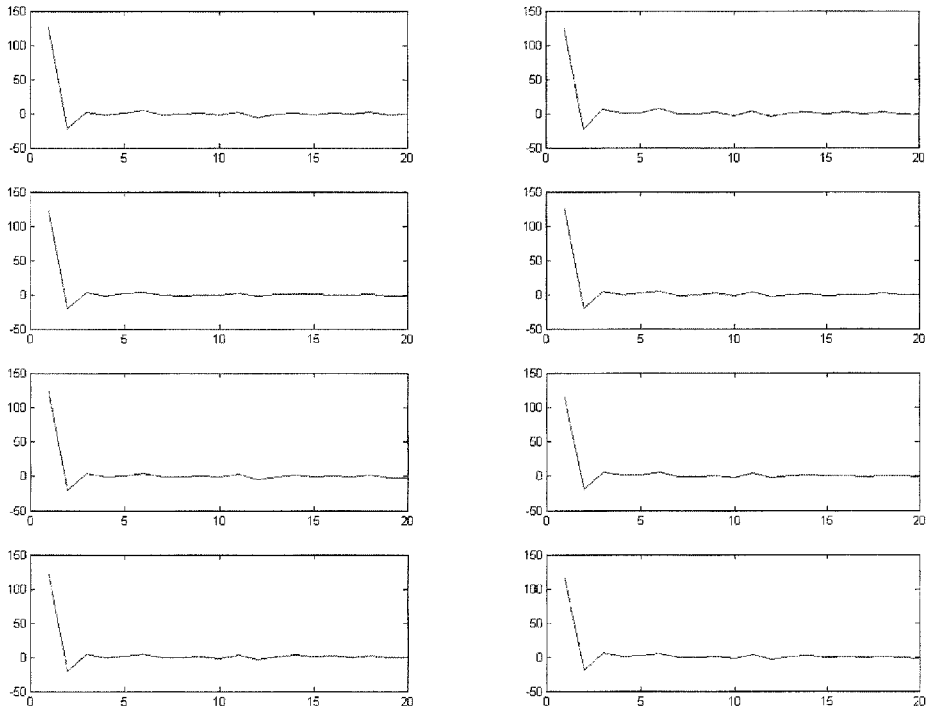
FIG. 3*g* shows Cepstrum coefficient diagrams corresponding to the Spectrum diagrams of FIG. 3*f*.

FIG. 3*g* shows Cepstrum DCT coefficient diagrams corresponding to the Spectrum diagrams of FIG. 3*f*. The x-axis is Quefrency, while the y-axis is magnitude. It can be seen that all eight plots of Cepstrum coefficients have very similar shape. The first coefficients of all eight signals have magnitude about 120. Such regularity makes the classification more accurate. The details about how this property can be used in classification is described in the following in relation to FIG. 3*h*.

The procedure to compute Cepstral coefficient may be as follows:

1. Divide the digitized time input signal into time frames.
2. Compute spectrum of the signal using Fourier transform.
3. Convert to Mel spectrum.
4. Take the logarithm upon amplitude spectrum.
5. Perform discrete cosine transform.

As the input time signal being processed might be non-stationary, the input signals are usually divided into smaller segments (some time called time window or frame). During the small segment time period, the signal can be seen as stationary. The second step is to transform the content of the windowed time signal to the frequency domain. The fourth step is to use logarithmic transformation to transform the signal from the frequency domain into what is called 'quefrency domain'. The waveform by such transformation is called 'cepstrum'. In many applications, in step 3 the Mel-scale filter bank method is applied. This is done in order to emphasize lower frequencies, which are perceptually more meaningful, as it is in human auditory perception, and the higher frequencies are down sampled more than lower frequencies. This is done in step 3. This step might be optional for certain sound signals. The last step is to perform discrete cosine transformation (DCT). The advantage of using DCT is that it is a real transformation, and no complex operation is involved. For speech signal, this may approximate principal components analysis (PCA). The Cepstral coefficients obtained from the above procedure including step 3 is called Mel Frequency Cepstral Coefficients, MFCC.

The detailed computation steps when calculating MFCC's are shown below:

Fourier Transform:

$$X[k] = \frac{1}{N}\sum_{n=0}^{N-1} x[n]e^{-jn\frac{2\pi}{N}k}n,\ k = 1, 2, \ldots, N \qquad \text{Eq. 2}$$

where N is the number of points in transformation.

This is the direct form. The fast computation can be obtained by FFT.

Mel-Scale Filter Banks:

The spectrum X[k] is transformed through use of Mel-scale filter banks H(k,m):

$$X'[m] = \sum_{k=0}^{N-1} |X[k]| \cdot H(k, m)\ m = 1, 2, \ldots, M \qquad \text{Eq. 3}$$

where M is the number of filter banks.

The Mel-scaled filter banks are defined as, see also reference 5:

$$H(k, m) = \begin{cases} 0 & \text{for } f_k < f_c(m-1) \\ \dfrac{f_k - f_c(m-1)}{f_c(m) - f_c(m-1)} & \text{for } f_c(m-1) \le f_k \le f_c(m) \\ \dfrac{f_k - f_c(m+1)}{f_c(m) - f_c(m+1)} & \text{for } f_c(m) < f_k \le f_c(m+1) \\ 0 & \text{for } f_k > f_c(m+1) \end{cases} \qquad \text{Eq. 4}$$

where fc is the centre frequencies for filter bank, and it is defined as:

$$f_c(m) = \begin{cases} 100(m+1) & \text{for } m = 0, 1, \ldots, 9 \\ 1000 \cdot 2^{0.2(m-9)} & \text{for } m = 10, 11, \ldots, 19 \end{cases} \qquad \text{Eq. 5}$$

Logarithmic Transformation:

$$X''[m] = \ln(X'[m]) \qquad \text{Eq. 6}$$

Discrete Cosine Transformation:

$$c(l) = \sum_{m=0}^{M-1} X''(m)\cos\left(l\frac{\pi}{M}\left(m + \frac{1}{2}\right)\right)\ l = 0, 1, \ldots, M-1 \qquad \text{Eq. 7}$$

The result c(l) obtained from the computation described above is known as Mel Frequency Cepstral Coefficients (MFCC). Such algorithm has been tested upon four different materials. These are: Pepsi bottle filled with half bottle of water, BF533 hardware reference book (904 pages), a metal tea box, and a coffee cup. 20 sound samples are generated from each material and recorded. In total 80 sound records are tested by the algorithm. The test results are shown in FIG. 3*h*, which shows the arrangement within a two-coefficient sound classification block system of the Mel Frequency Cepstral Coefficient sound vectors corresponding to the detected sounds from these four different materials.

Figure 3H:
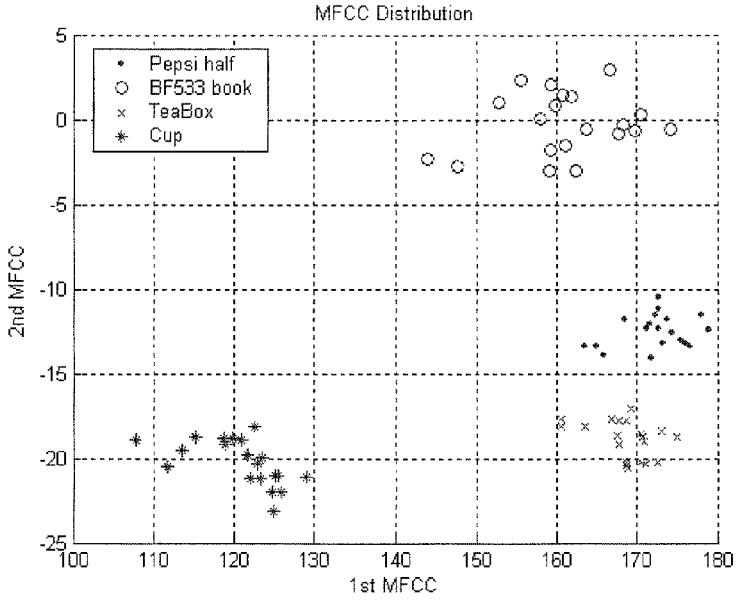
FIG. 3*h* illustrates the arrangement within a two-coefficient sound classification block system of Mel Frequency Cepstral Coefficient sound vectors corresponding to detected sounds from four different materials and based on characteristic features obtained by use of cepstrum analysis according to an embodiment of the present invention.

Only the first two MFCC coefficients are used for the plot shown in FIG. 3*h*. Two coefficients correspond to a point in the coordinate system. The plot in FIG. 3*h* shows that the recorded points are scattered in the coordinate system. But the points being generated from the same material are closely located. No overlap has been found among the different materials. This method may be used to material recognition.

Classification

A classification block is used to categorize a given feature of input signal into a specific class or group. In order to classify a give signal, the system must have enough knowledge of that specific class. Since the features of the signals may be plotted in a coordinate system, each class will be located closely in a region in the coordinate system. The region of one class will be the knowledge of that class. To build such knowledge, training is required. Therefore, a classification block has two modes of operation, i.e. Training mode and Classification mode. The classification block or region can be represented in several ways. At current, two ways are considered, i.e. Binary representation and Gaussian distribution representation. In the following section, each representation is explained, and training and classification for each representation is described.

Binary Representation

A binary representation is obtained by using True/False (1/0) value to show that the region belongs to different classes. For example, for a 2-dimensional coordinate system with 3 different classes, the regions can be seen as illustrated in FIG. 4*a*.

Figure 4A:
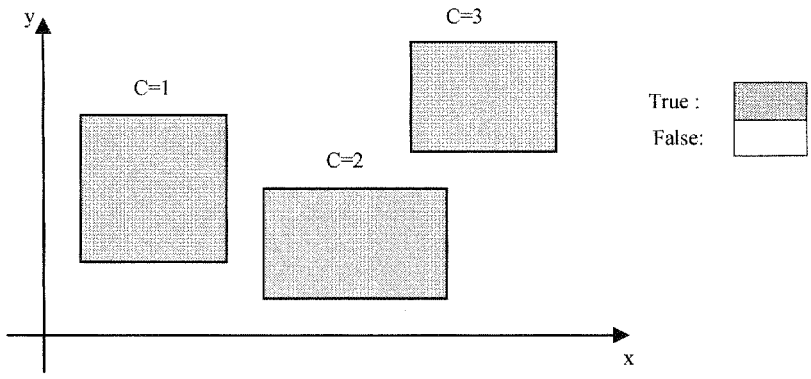
FIG. 4*a* illustrates an example of binary representation classification of input signals according to an embodiment of the present invention.

In FIG. 4*a*, the regions shaded with grey colour represents True, False elsewhere. During classification, the feature of a given signal will be mapped onto this coordinate system. If it falls onto one of the grey regions, the result will be True. The class of that signal will be the class of that region. If the feature of the signal does not fall into any of the regions, the classification result will be False, and the signal belongs to an unknown source.

For a 2-D coordinate system, the region is a plane. For a 3-D coordinate system, the region may be a cube. For a high dimensional coordinate system, the region may be a hyperplane.

The training involves examples of signals from known source. For one kind of sound source, several samples are recorded (usually 10~20 or more). The sound records are feed to the system in 'Training mode'. The system may be adapted to construct the classification regions in the coordinate system. The simplest construction of a classification region is to make a rectangle that contains all the examples. The obtained region may be labelled with the name of the sound source. Since the label of the examples is given together with the examples, such kind of training is called supervised training. According to this approach the classification regions must not be overlapping, which is illustrated in FIG. 4*a*. If overlapping occurs, it has to be adjusted into smaller regions or into polygons that avoid overlapping. When one class has been trained, another class can be trained in the system.

In order to relax such restriction, another representation such as Gaussian distribution can be used. Here, the classification regions are modelled by statistics with probability density estimation. The details are described in the following.

Gaussian Distribution Representation

Instead of providing True/False results, classification can also be done by probabilities. When having a high number of input examples being generated from the same source, the data are likely to appear as having a Gaussian distribution. Most of the data are distributed around the mean μ, and few data will be away from the mean, which spread in data is specified by the variance σ2. The Gaussian distribution density function for uni-variate distribution is expressed as:

$$p(x) = \frac{1}{\sqrt{2\pi\sigma^2}} \exp\left\{-\frac{(x-\mu)^2}{2\sigma^2}\right\} \quad \text{Eq. 8}$$

Where μ and σ2 are mean and variance.

The mean and variance of the one-dimensional Gaussian distribution is found by:

$$\mu = \varepsilon[x] = \int_{-\infty}^{\infty} x \cdot p(x)\, dx \quad \text{Eq. 9}$$

$$\sigma^2 = \varepsilon[(x-\mu)^2] = \int_{-\infty}^{\infty} (x-\mu)^2 p(x)\, dx$$

where ϵ(x) denotes the expectation.

For multi-variate Gaussian, the density function can be written as:

$$p(x) = \frac{1}{\sqrt{(2\pi)^d |\Sigma|}} \exp\left\{-\frac{1}{2}(x-\mu)^T \Sigma^{-1} (x-\mu)\right\} \quad \text{Eq. 10}$$

where μ is a d-dimensional mean vector, and Σ is a d×d covariance matrix; they can be found by:

$$\mu = \epsilon[x]$$

$$\Sigma = \epsilon[(x-\mu)(x-\mu)^T] \quad \text{Eq. 11}$$

The classification by use of uni-variate Gaussian distribution may not be adequate, and multi-variate Gaussian distribution can be used. For a 2-dimensional Gaussian distribution, the density can be visualized as shown in FIG. 4*b*.

Figure 4B:
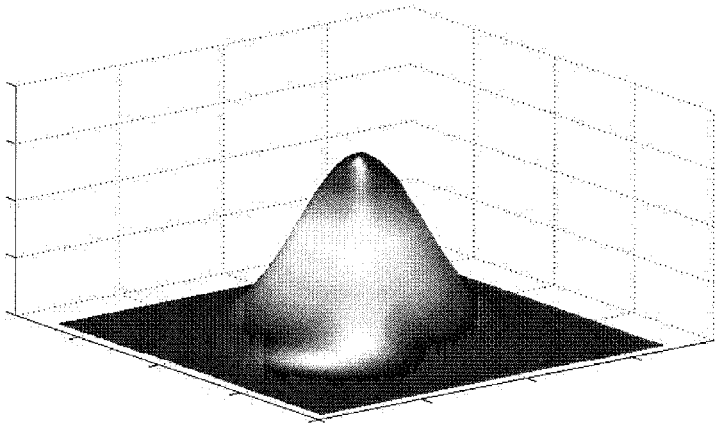
FIG. 4*b* illustrates an example of probability classification of input signals according to an embodiment of the present invention.

If the Gaussian distribution is used for classification as illustrated in FIG. 4*b*, then the horizontal axes represent the selected frequency components with highest amplitude, while the vertical axis represents the probability of being in that class.

The training for Gaussian distribution representation may take a high number of training examples in order to create a Gaussian model. The training can be understood as a task for probability density estimation. There are several different known ways to estimate probability density. A systematic study can be found in reference 7, which is hereby included by reference.

Output Mapping

According to an embodiment of the present invention as illustrated in FIG. 2*a*, the classification result may further be processed by use of the 'Output mapping', 204*a*. It should be noted that the present invention also covers embodiments without the Output mapping function, including embodiments in which a sound effect may be directly associated with a signal class.

The purpose of including an output mapping is to allow the method and system of the present invention to be used in many different configurations or scenarios. The classification algorithm, 203*a*, may classify the input signal into a class C. C is sometime called the label of the signal. The 'Output mapping' block, 204*a*, may map the label C into a decision D. The decision D may be used when producing the output.

Configuration

The current and simplest implementation of output mapping is linear one-to-one mapping, so that:

D=C i.e.

$$D = \begin{cases} 1, & C = 1 \\ 2, & C = 2 \\ 3, & C = 3 \\ & \ldots \end{cases} \quad \text{Eq. 12}$$

However, the system is not constrained to such mapping. The system can be configured to comprise a non-linear mapping, e.g.

$$D = \begin{cases} 1, & C = 1, 2 \\ 2, & C = 3 \\ 3, & C = 4, 5 \end{cases} \quad \text{Eq. 13}$$

Or reverse mapping, e.g.

$$D = \begin{cases} 1, & C = 7 \\ 2, & C = 8 \\ 3, & C = 9 \\ & \ldots \end{cases} \quad \text{Eq. 14}$$

The configuration can be changed offline before production, or online selected by the user. For offline configuration, once it is configured, it will be fixed and cannot be altered. For online configuration, it can be changed by push buttons or alike.

Setup

Hardware setup of the system can also change the output mapping. The system can be equipped with sensors that measure the force, acceleration, rotation and etc. in order to produce an input signal. The information from such sensor input can alter the output mapping. For example, when the user rotates the sensor 45°, the system can change the mapping by altering the configuration.

Scenario

The system can be used in many different scenarios. In different scenarios, the output mapping can be altered as well. For example, the mapping can be different when it is a in a concert or open space performance. The scenario can be determined by mode input selected by user.

Functional Diagram

Figure 5:
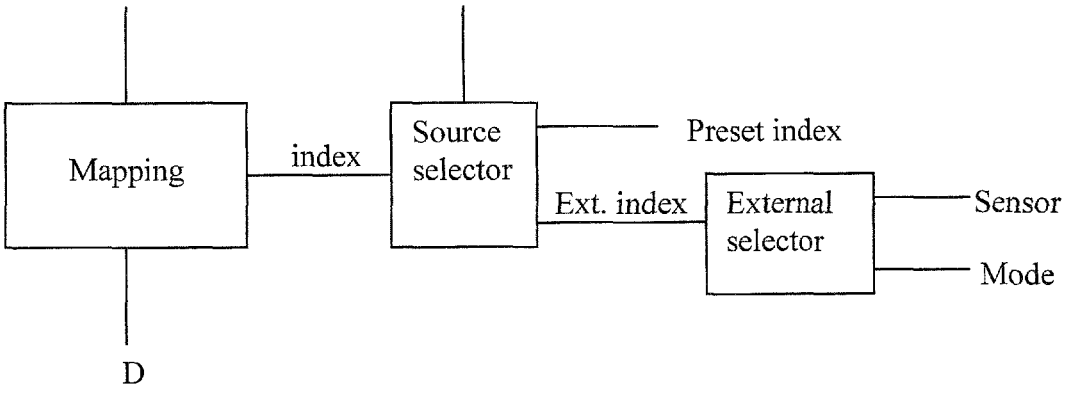
FIG. 5 is a block diagram illustrating mapping of a selected signal class into a sound effect according to an embodiment of the present invention.

FIG. 5 is a block diagram illustrating mapping of a selected signal class into a sound effect according to an embodiment of the present invention, The mapping from C to D is performed by selecting a certain configuration indicated by 'index'. The 'index' can be a fixed preset value or from an external selector indicated by 'Source'. The external selector may be a function of both 'sensor reading' and 'Mode' selection.

An example is shown below:

TABLE 2.1

C to D mapping

| Index | C to D Mapping |
|---|---|
| 1 | One-to-one |
| 2 | Non-linear |
| 3 | Reverse |
| 4 | . . . |

TABLE 2.2

Source of index

| Source | Index |
|---|---|
| 0 | Preset index = 3 |
| 1 | Ext. Index |

TABLE 2.3

External index

| Ext. Index | Sensor | Mode |
|---|---|---|
| 1 | 0° | 00 = 'Concert' |
| 2 | 45° | 00 = 'Concert' |
| 3 | 0° | 11 = 'Open space performance' |
| 4 | 45° | 11 = 'Open space performance' |

In this example, Table 2.1 defines the C to D mapping selected by 'Index'. Table 2.2 defines the source the index. Table 2.3 defines external index.

Assume: 'Preset index'=3, 'Sensor'=45° and 'Mode'=00,

If 'Source'=0, the 'preset index' is selected. So 'Index'='preset index'=3, C to D will be reverse mapping. If 'Source'=1, the 'Ext. Index' is selected. Based on 'Sensor' reading and 'Mode' selection, 'Index'='Ext.Index'=2, C to D of Non-linear mapping is selected.

With decision value D, the output can be generated, which is further described in the following.

Output Generation

The output generation, 205*a*, may be a simple sound signal synthesis process. Several audio sequences may be recorded and stored in an external memory on the signal processing board. When a decision is made by the algorithm, 204*a*, the corresponding audio record may be selected. The selected record may be sent to an audio codec and via a D/A converter produce the sound output. The intensity of the produced sound may in a preferred embodiment of the invention correspond to the intensity of the input signal.

The basic idea is to compare the current input signal intensity with a reference intensity, a factor between these two intensities can be determined and named "Intensity factor". This factor may then be used to adjust the output signal intensity.

The "Reference Intensity" may be determined during a training process. For sufficient amount of training examples from the same material (such as 20 examples from a cup), the algorithm may be applied. The magnitude of the peak spectrum may be found. For N examples, there will be N peak magnitude values. The mean value of the N values is found, and this mean value may be defined as the "Reference Intensity".

Similarly, the magnitude of the peak spectrum for the current input signal can be calculated in real time. This value is compared with the "Reference Intensity", and a factor may be computed as:

$$F = \frac{\text{Current Intensity}}{\text{Reference Intensity}}$$

This factor may be used to scale the output signal amplitude. For example, 20 sound examples generated from a cup are recorded and used for training. The magnitudes of the peak spectrum for each example are found. The mean value over all 20 magnitude values are computed and denoted as RICUP. In this example as shown in Table 3.1, RICUP=1311.

TABLE 3.1

| Reference Intensity | | | | | | | | | | |
|---|---|---|---|---|---|---|---|---|---|---|
| | Example | | | | | | | | | |
| | 1 | 2 | 3 | 4 | 5 | 6 | ... | 18 | 19 | 20 |
| Magnitude | 1000 | 1500 | 1200 | 1500 | 1200 | 1300 | ... | 1200 | 1400 | 1500 |

RICUP = Mean = 1311

Further, assuming that the magnitude of the peak spectrum of the current input signal (also generated from a cup) is found to be 1000, which is then equal to the "Current Intensity", the factor F is found to be $$F = \frac{1000}{1311} = 0.769.$$

The output sound record may then be scaled by F, i.e. each output sample may be multiplied with F.

Timing Evaluation

A system according to an embodiment of the present invention is implemented by use of an Analog Device Blackfin digital signal processor. In this embodiment, the processor BF537 is used. This processor operates at 300 MHz frequency.

Spectrum Analysis

The algorithm using spectrum analysis is used in this embodiment. The program first takes enough samples, computes fast Fourier transform and determines the frequency with highest magnitude. Decision is made based on the magnitude. The tasks to be performed are: Sampling of time windows, perform FFT on sampled signal windows, obtain amplitude spectrum by Absolute, obtain peak spectrum by Max, and perform Classification. These program steps are illustrated in FIG. 6*a*, which is a block and timing diagram illustrating the principle tasks in a classification process performed by use of spectrum analysis according to an embodiment of the present invention.

The data is sampled by an audio codec, which samples at 48 kHz. When a sample is ready, it signals an interrupt to the digital signal processor. The fast Fourier transform is performed by invoking the FFT( ) function from the DSP library. The FFT produces a complex frequency spectrum. The magnitude or amplitude is taken by using the abs( ) function provided by Blackfin API. Similarly, the peak of frequency spectrum is found by using the max( ) function over all the obtained spectrum. The classification is implemented with if-else branching statements.

Figure 6A:
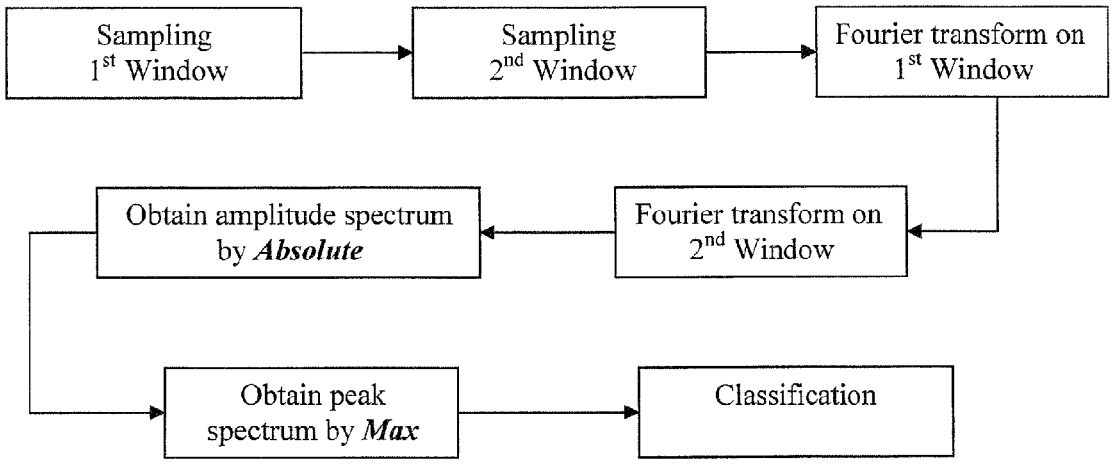
FIG. 6*a* is a block and timing diagram illustrating the principle tasks in a classification process performed by use of spectrum analysis according to an embodiment of the present invention.

This scheduling shown in FIG. 6*a* is not optimal in term of response time. The computation starts when two windows of data have been sampled. However the frequency spectrum of the second window is computed separately from the first. Likewise for abs( ) and max( ) operations. The computation for the first window can be started during second window is sampling.

Figure 6B:
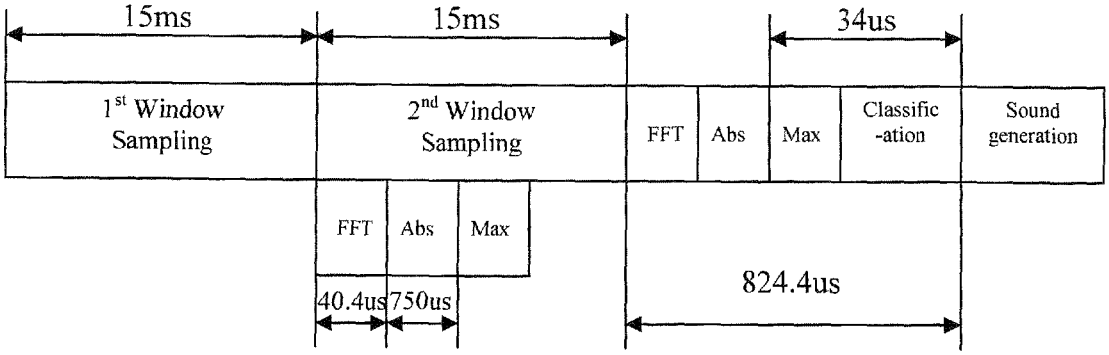
FIG. 6*b* is an exemplary timing diagram corresponding to the block diagram of FIG. 6*a*.

The improved scheduling is illustrated in FIG. 6*b*, which shows an exemplary timing diagram for processing the block diagram of FIG. 6*a*. For the diagram of FIG. 6*b*, each sampling takes 15 ms, in total 30 ms for two windows. The Fast Fourier transform operation takes about 40.4 us. To compute the absolute values for one window, 750 us are used. To perform maximum operation and classification task takes in total 34 us. From the time that the second window is completely sampled, to the generation of the output sound signal, there are used 824.4 us in computation time. By using the scheduling of FIG. 6*b*, the computing time for the first window FFT and absolute value are saved.

Those skilled in the art will appreciate that the invention is not limited by what has been particularly shown and described herein as numerous modifications and variations may be made to the preferred embodiment without departing from the spirit and scope of the invention.

References

[1] A. V. Oppenheim, R. W. Schafer, From Frequency to Quefrency: A History of the Cepstrum, Signal Processing Magazine, IEEE, Issue. 5 2004

[2] Beth Logan, Mel frequency cepstral coefficients for music modelling, Cambridge research laboratory, Compaq Computer co.

[3] S. Molau, M. Pitz, R. Schluter, H. Ney, COMPUTING MEL-FREQUENCY CEPSTRAL COEFFICIENTS ON THE POWER SPECTRUM, Acoustics, Speech, and Signal Processing, 2001

[4] James W. Cooley, John W. Tukey, An algorithm for the machine calculation of complex Fourier series, Mathematics of Computation, Vol. 19. No. 90, April 1965

[5] H. P. Combrinck, E. C. Botha, On the Mel Scaled Cepstrum, University of Pretoria, Sound Africa

[6] Discrete cosine transform. (2006, Jul. 16). In Wikipedia, The Free Encyclopedia. Retrieved 14:07, Jul. 18, 2006, from http://en.wikipedia.org/w/index.php?title=Discrete_cosine_transform&oldid=64153010.

[7] C. M. Bishop, Neural networks for pattern recognition, Oxford Clarendon Press 1997, ISBN: 0-19-853864-2

The invention claimed is:

1. A method for providing sound generation instructions from a digitized input signal, said method comprising:

transforming by use of time-frequency transformation at least part of the digitized input signal into a feature representation, extracting characteristic features of the obtained feature representation, comparing at least part of the extracted characteristic features against stored data representing a number of signal classes, selecting a signal class to represent the digitized input signal based on said comparison, selecting from stored data representing a number of sound effects sound effect data representing the selected signal class, determining sound volume data from stored reference volume data corresponding to the selected signal class and/or sound effect and from at least part of the obtained characteristic features, and generating sound generation instructions based at least partly on the obtained sound effect data and the obtained sound volume data, said method being characterised in that for a selected signal class the corresponding stored reference volume data is at least partly based on a number of training maximum amplitudes obtained at corresponding peak frequencies during a preceding training process including generation of several digitized input signals, each said digitized input signal being based on one or more generated signals to be represented by the selected signal class.

2. A method according to claim 1, said method further comprising forwarding the sound generation instructions to a sound generating system, and generating by use of said sound generating system and the sound generation instructions a sound output corresponding to the digitized input signal.

3. A method according to claim 1, wherein said stored data representing signal classes are data representing signal classification blocks.

4. A method according to claim 1, wherein the step of transforming the digitized input signal into a feature representation includes the use of Fourier transformation.

5. A method according to claim 4, wherein the step of extracting the characteristic features comprises an extraction method using spectrum analysis and/or cepstrum analysis.

6. A method according to claim 1, wherein the time-frequency transformation comprises dividing at least part of the digitized input signal into a number of time windows M, with M being at least two, with a frequency spectrum being obtained for each input signal time window.

7. A method according to claim 6, wherein for each the time window M, the frequency component having maximum amplitude is selected, to thereby obtain a corresponding number M of characteristic features of the digitized input signal.

8. A method according to claim 7, wherein said stored data representing signal classes are data representing signal classification blocks, and wherein each stored signal classification block has a frequency dimension corresponding to the number of time windows M.

9. A method according to claim 8, wherein the obtained M maximum amplitude frequencies of the digitized input signal are compared to the stored signal classification blocks, and the selection of a signal class is based on a match between the obtained frequencies and the stored signal classification blocks.

10. A method according to claim 1, wherein the step of extracting the characteristic features comprises an extraction method based on one-window cepstrum analysis.

11. A method according to claim 10, wherein a number N of Mel Frequency Cepstral Coefficients, MFCC, are obtained for a single time window representing a part of the digitized input signal.

12. A method according to claim 11, wherein said stored data representing signal classes are data representing signal classification blocks, and wherein each stored signal classification block has a dimension corresponding to the number N of MFCC's.

13. A method according to claim 11, wherein N is selected from the group of numbers represented by 2, 3, 4 and 5.

14. A method according to claim 1, wherein for each signal class there is corresponding stored sound effect data indicative of a sound effect belonging to the selected signal class.

15. A method according to claim 1, wherein for each signal class there is corresponding reference volume data.

16. A method according to claim 15, wherein time-frequency transformation is used in transforming the digitized input signal into the feature representation, and wherein one or more maximum amplitudes are obtained for corresponding peak frequencies from the characteristic features of the digitized input signal, and the sound volume data is determined based on the obtained maximum amplitude(s) and the stored reference volume data.

17. A method according to claim 14, wherein time-frequency transformation is used in transforming the digitized input signal into the feature representation, and wherein stored signal class data is at least partly based on a number of training maximum amplitude or peak frequencies obtained during a preceding training process including generation of several digitized input signals, each said digitized input signal being based on one or more generated signals to be represented by the selected signal class.

18. A method according to claim 1, wherein the step of selecting sound effect data representing a selected signal class includes a mapping process in which the selected class is mapped into one or more given sound effects based on a predetermined set of mapping rules.

19. A method according to claim 4, wherein the digitized input signal(s) is/are based on detected sound and/or vibration signal(s) being generated when a first body is contacting a second body.

20. A system for providing sound generation instructions from a digitized input signal, said system comprising:

memory means for storing data representing a number of signal classes and a number of sound effects and further representing reference volume related data corresponding to the signal classes and/or sound effects, one or more signal processors, and a sound generating system, said signal processor(s) being adapted for transforming at least part of the digitized input signal into a feature representation by use of time-frequency transformation, for extracting characteristic features of the obtained feature representation, for comparing at least part of the extracted characteristic features against the stored data representing a number of signal classes, for selecting a signal class to represent the digitized input signal based on said comparison, for selecting from the stored data representing the number of sound effects sound effect data corresponding to or representing the selected signal class, for determining sound volume data from stored reference volume data corresponding to the selected signal class and/or sound effect and from at least part of the obtained characteristic features, and for generating sound generation instructions and forwarding said sound generation instructions to the sound generating system, said sound generation instructions being based at least partly on the obtained sound effect data and the obtained sound volume data, said system being characterised in that for a selected signal class the stored reference volume data is at least partly based on a number of training maximum amplitudes obtained at corresponding peak frequencies during a training process including generation of several digitized input signals, each said digitized input signal being based on one or more generated signals to be represented by the selected signal class.

21. A system according to claim 20, wherein said stored data representing signal classes are data representing signal classification blocks.

22. A system according to claim 20, wherein the signal processor(s) is/are adapted for transforming the digitized input signal into a feature representation by use of Fourier transformation.

23. A system according to claim 20, wherein the signal processor(s) is/are adapted for extracting the characteristic features by use of an extraction method comprising spectrum analysis and/or cepstrum analysis.

24. A system according to claim 20, wherein the signal processor(s) is/are adapted for dividing at least part of the digitized input signal into a number of time windows M, with M being at least two.

25. A system according to claim 24, wherein the signal processor(s) is/are adapted for using spectrum analysis for extracting the characteristic features with a frequency spectrum being obtained for each input signal time window.

26. A system according to claim 25, wherein for each time window M, the signal processor(s) is/are adapted to select the frequency component having maximum amplitude, to thereby obtain a corresponding number M of characteristic features of the digitized input signal.

27. A system according to claim 26, wherein said stored data representing signal classes are data representing signal classification blocks, and wherein each stored signal classification block has a frequency dimension corresponding to the number of time windows M.

28. A system according to claim 27, wherein the signal processor(s) is/are adapted to compare the obtained M maximum amplitude frequencies of the digitized input signal to the stored signal classification blocks, and further being adapted to select a signal class based on a match between the obtained frequencies and the stored signal classification blocks.

29. A system according to claim 20, wherein the signal processor(s) is/are adapted for extracting the characteristic features by use of an extraction method based on one-window cepstrum analysis.

30. A system according to claim 29, wherein the signal processor(s) is/are adapted for obtaining a number N of Mel Frequency Cepstral Coefficients, MFCC, for a single time window representing a part of the digitized input signal.

31. A system according to claim 30, wherein said stored data representing signal classes are data representing signal classification blocks, and wherein each stored signal classification block has a dimension corresponding to the number N of MFCC's.

32. A system according to claim 30, wherein N is selected from the group of numbers represented by 2, 3, 4 and 5.

33. A system according to claim 20, wherein for each signal class there is corresponding stored sound effect data indicative of the sound effect belonging to the selected signal class.

34. A system according to claim 20, wherein for each signal class there is corresponding reference volume data.

35. A system according to claim 34, wherein the signal processor(s) is/are adapted for using spectrum analysis for extracting the characteristic features, the signal processor(s) is/are adapted for determining one or more maximum amplitudes for corresponding peak frequencies from the characteristic features of the digitized input signal, and the signal processor(s) is/are further adapted to determine the sound volume data based on the obtained maximum amplitude(s) and the stored reference volume data.

36. A system according to claim 20, wherein the signal processor(s) is/are adapted for using spectrum analysis for extracting the characteristic features, and wherein the stored signal class data is at least partly based on a number of training maximum amplitude frequencies or peak frequencies obtained during a training process including generation of several digitized input signals, each said digitized input signal being based on one or more generated signals to be represented by the selected signal class.

37. A system according to claim 20, wherein the signal processor(s) is/are adapted for selecting sound effect data representing a selected signal class by use of a mapping process in which the selected class is mapped into one or more given sound effects based on a predetermined set of mapping rules.

38. A system according to claim 20, wherein the digitized input signal(s) is/are based on detected sound and/or vibration signal(s) being generated when a first body is contacting a second body.

* * * * *